United States Patent [19]

Young et al.

[11] 4,283,365

[45] Aug. 11, 1981

[54] PROCESS FOR MELT-SPINNING ACRYLONITRILE POLYMER FIBER USING VERTICALLY DISPOSED COMPRESSION ZONE

[75] Inventors: Chi C. Young; Francesco DeMaria, both of Gulf Breeze, Fla.

[73] Assignee: American Cyanamid Company, Stamford, Conn.

[21] Appl. No.: 13,352

[22] Filed: Feb. 21, 1979

[51] Int. Cl.[3] ..... D01F 6/18

[52] U.S. Cl. ..... 264/206; 264/210.7; 264/211

[58] Field of Search ..... 264/211, 210.7, 206, 264/176 F

[56] References Cited

U.S. PATENT DOCUMENTS

| | | | |
|---|---|---|---|
| 3,585,263 | 6/1971 | Rassart | 264/176 F |
| 3,627,867 | 12/1971 | Schwarz | 264/211 |
| 3,991,153 | 4/1976 | Klausner et al. | 264/211 |
| 4,117,073 | 9/1978 | Koch et al. | 264/349 |
| 4,163,770 | 8/1979 | Porosoff | 264/210.3 |

*Primary Examiner*—Jay H. Woo

*Attorney, Agent, or Firm*—Frank M. Van Riet

[57] ABSTRACT

Use of a vertically disposed compression zone for providing a fusion melt of acrylonitrile polymer and water in conjunction with melt spinning provides reduced bubble count in the resulting fiber.

4 Claims, 1 Drawing Figure

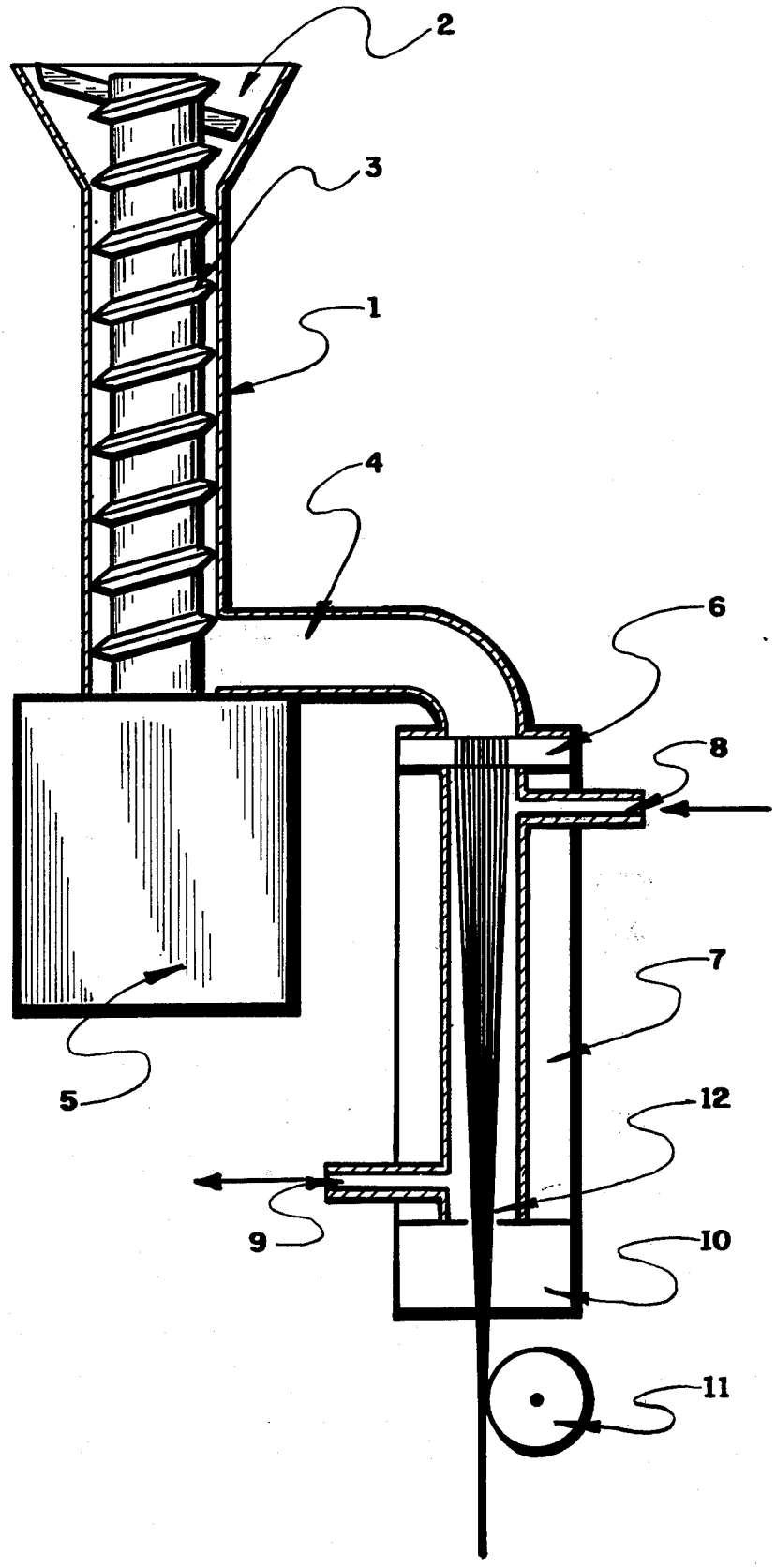
2
3
1
4
6
8
7
5
12
9
10
11

PROCESS FOR MELT-SPINNING ACRYLONITRILE POLYMER FIBER USING VERTICALLY DISPOSED COMPRESSION ZONE

This invention relates to an improved process for melt-spinning an acrylonitrile polymer fiber. More particularly, this invention relates to such a process wherein a solid polymer-water composition is fed to a vertically disposed compression zone wherein it is compacted and melted under autogeneous pressure to form a homogeneous fusion melt which is extruded through a spinnerette assembly by pressure generated within the compacting zone directly into a steam-pressurized solidification zone maintained under conditions which control the release of water from the nascent filaments so as to avoid deformation thereof.

Compacting zones used in conjunction with extrusion may be operated in different modes. The most desirable mode of operation for a particular application is, therefore, a matter of choice and must be determined in individual instances. In Society of Plastics Engineers 36th Annual Technical Conference, Washington, D.C., Apr. 24–27, 1978, there were two papers presented described opposing modes of operation. The "Extruder Performance In The Metered-Starved Feeding Mode" by J. M. McKelvey and S. Steingiser, pages 507–511 of the published papers, good results are reported using a mode of operation in which the extruded feed is metered so that the capacity of the extruder is not satisfied. In "Forced-Feeding Zone Improves The Extrusion Properties" by B. Franzkoch and G. Menges, pages 512–515 of the published papers, it is reported that good results are obtained using a mode of operation that is diametrically opposed to the previous article. Both of these articles are departures from a mode of operation using the intended extruder capacity which must be assumed to be the criterion over which the reported modes are improvements. A wide number of variations are possible within the extreme modes described and no specific techniques with respect to which mode is best suited for specific applications are given.

Recent developments in the field of acrylonitrile polymer fibers have lead to the provision for a melt-spinning process involving fusion melts. A fusion melt is a composition of a fiber-forming acrylonitrile polymer and water in proportions which form a homogeneous single phase melt under suitable conditions of temperature and pressure. Water serves as a melt assistant and enables the polymer to form a melt at a temperature below that at which the polymer normally melts or deteriorates, the water becoming intimately associated with the polymer so that a single phase melt results. The melting point of the polymer-water composition is above the atmospheric boiling point of water and consequently superatmospheric pressure is necessary to maintain water in liquid state.

In processing such a fusion melt into fiber, the fusion melt is typically prepared in a horizontally disposed compression zone to which the polymer-water mixture is continuously fed as granules. As the granules move through the compression zone, they are compacted and heated to provide the fusion melt prior to entering a spinnerette assembly. The problem of containing pressure within an extruder is particularly difficult in those instances where water is required to obtain a polymer melt. The combination of water and polymer does not provide a plastic melt until the fusing and melting temperatures are reached, until then the mixture forms a brittle, crumbly solid with little or no resistance to pressure. Vapors of water generated in the melt zone move toward the solid approaching the melt zone because of the pressure generated in the melt zone. These vapors can move through the loose granules and escape by blowing through the feed inlet. To prevent blowing, the vapors are sometimes removed by controlled venting of the melt zone in order to reduce the internal pressure and minimize the differential in pressure with respect to the feed and melt zones. This remedy, however, lowers the concentration of melt assistant which is needed for proper melting of the polymer.

In U.S. Pat. No. 3,991,153 issued Nov. 9, 1976, to Klausner et al there is described a process for the continuous extrusion of a fusion melt of acrylonitrile polymer and water which comprises forming a porous plug of the composition being extruded in a horizontally disposed extruder, said plug being formed at a point intermediate to the compression zone and the melt zone, and advancing said plug toward the extruder outlet at a linear rate equal to the rate at which vapor condensed in the porous plug moves toward the feeding zone as a result of pressure generated within the melt zone so that escape of water vapor is prevented. While this process is highly satisfactory in melt-spinning fusion melts of acrylonitrile polymer and water in a horizontally disposed compression zone, it is not appropriate for use with vertically disposed compression zones due to the differences in orientation of the compression zones.

In accordance with the present invention, there is provided a process for preparing an acrylonitrile polymer fiber which comprises continuously feeding a particulate composition of about 70 to 95 weight percent of a fiber-forming acrylonitrile polymer, and correspondingly, from about 30 to about 5 weight percent of water into the top of a vertically disposed compression zone operating at a compression ratio of greater than about 1:1 and less than about 1:3 and at a temperature sufficient to provide a fusion melt at autogeneous pressure, said feeding being conducted at a rate which satisfies the operating capacity of said compression zone so as to provide a vapor seal and extruding the resulting fusion melt from the bottom of said compression zone through a spinneret assembly using the pressure generated within said compression zone, said extruding being directly into a steam-pressurized solidification zone maintained under conditions which control release of water from the nascent filaments to prevent deformation thereof.

The process of the present invention provides a number of advantages over prior art procedures using compression zones in extruding fusion melts of acrylonitrile polymer and water. The present process is operative with fine powder compositions as well as with granules. The pressure generated in the compression zone is sufficient to effect extrusion of the fusion melt without the need for an auxiliary pump. By feeding the particulate composition to the compression zone at a rate which fills the operating capacity thereof to form a vapor seal, need for forming a porous plug is eliminated. The fiber formed has a reduced bubble content compared with fibers formed by other processes of extruding fusion melts and better fiber properties result.

The process of the present invention is described with particular reference to the sole FIGURE of drawing which shows a schematic representation of suitable processing equipment. In the Drawing, 1 represents a vertically disposed compression zone having a feed hopper 2, screw flight 3, and an exit 4 at the bottom. Drive means 5 and other controls, not shown, control operation of the compression zone. From the exit end 4, the fusion melt provided is conducted to the spinneret assembly 6 through which it is extruded by pressure generated within the compression zone. The spinneret assembly 6 feeds directly into a steam-pressurized solidification zone 7 provided with a steam inlet 8 and steam outlet 9 which maintain suitable steam pressure within the zone to control release of water from the nascent extrudate to prevent deformation thereof. A pressure seal 10 enables release of the extrudate from the solidification zone while maintaining pressure therein. A take-up roll 11 may be used to collect the extrudate or provide stretch thereto.

In carrying out the process of the present invention, a fiber-forming acrylonitrile polymer is used in conjunction with water to form a homogeneous fusion melt. Generally, any fiber-forming acrylonitrile polymer that forms a fusion melt with water can be used and such polymers are known in the art. Preferred polymers are those that contain at least about 50 weight percent of acrylonitrile and at least about 1 weight percent of a copolymerizable monomer.

The selected mixture of fiber-forming acrylonitrile polymer and water in proper porportions to provide a homogeneous single-phase fusion melt are prepared in the form of particulate solids. The proper proportions of polymer will generally range from about 70 to 95 weight percent and the proper proportions of water will generally range, correspondingly, from about 30 to about 5 weight percent based on the total weight of the polymer-water composition. The actual proportions will vary within these ranges depending upon the polymer composition and operating conditions and can readily be determined from an appropriate phase diagram. Within the range of polymer-water compositions operative as described, the composition at ambient conditions will be a solid particulate because the water is adsorbed by the polymer. The solid particulate used may be a fine particulate or coarse granules. It is generally preferred to employ fine particulates since they require no special preparative steps.

The solid particulate polymer-water composition is continuously fed to the top of the compression zone via the feed hopper. The rate of feeding the composition should be sufficient to satisfy the operating capacity of the compression zone so as the provide a vapor seal therein. The operating capacity of the compression zone includes the screw flights volume plus the clearance between the screw flights and the barrel of the compression zone. By filling this operating capacity of the compression zone, a vapor seal is provided and water present in the polymer-water composition cannot escape from the compression zone as the fusion melt forms at lower depths within the compression zone.

As the polymer-water composition is forced down the compression zone by the screw flights, it is compacted and heated so as to form a fusion melt under autogeneous pressure. External heat is provided through controls to the compression zone which with the compression provided by the screw flights generates sufficient pressure to maintain water in liquid state in the fusion melt provided. Generally, compression is at a compression ratio greater than about 1:1 and less than about 1:3, preferably about 1:2. The compression ratio is the volume occupied by the particulate feed material. Thus, at the preferred compression ratio of 1:2, the volume occupied by the fusion melt formed is one-half that occupied by the particulate feed. The fusion melt which forms at the lower depths of the compression zone exits from the bottom of the compression zone with sufficient pressure being generated within the compression zone to extrude the fusion melt through a spinnerette assembly.

The fusion melt exiting from the compression zone is extruded through a spinneret assembly by this compression pressure generated within the compression zone. The spinneret assembly is one useful in melt-spinning of fusion melts of acrylonitrile polymer and water and provides extrudates in filamentary form. Any spinneret assembly useful in melt-spinning may be used.

The spinneret assembly issues the extrudates directly into a steam-pressurized solidification zone maintained under suitable conditions to control release of water from the nascent extrudate to prevent deformation thereof. Without the steam-pressurized solidification zone, the nascent extrudates would have swollen or puffed structure because of rigid evolution of water vapors from their interiors and highly deformed or foamed popcorn structures would result which would severely detract from the commodity value of the extrudates as filamentary materials. By maintaining adequate steam pressure within the steam-pressurized solidification zone, the extrudates will solidify and the rate of release of water from the extrudates is controlled so that deformation of the filamentary structure does not occur. Generally, the steam pressure to be employed in the solidification zone will vary widely depending upon the polymer employed, the water content of the polymer-water composition; the extrusion temperature, and other considerations. However, useful steam pressures are generally those that provide a temperature in the solidification zone that is about 10° to 30° C. below the minimum melting temperature of the polymer-water composition. Useful steam pressures control the rate of evaporation of water from the nascent filaments. By controlling this rate, skin formation on the outer surface of the extrudate is minimized and deformation is avoided since diffusion of water vapor through the extrudate is not restricted. The solidification zone is equipped with a pressure seal through which the extrudate can be discharged to the atmosphere while maintaining steam pressure within the solidification zone.

While the extrudate is within the steam-pressurized solidification zone, it is preferred to subject the extrudate to stretching to provide molecular orientation which leads to desirable fiber properties. Such stretching may be accomplished in a single stage, or for textile applications, it is generally preferred to employ a stretch ratio of at least about 25, preferably in two stages with the first stage conducted at a stretch ratio less than that used in the second stage.

When the extrudate has been subjected to stretching while it remains in the steam-pressurized solidification zone, it is preferred to relax the stretched fiber in steam to obtain a desirable balance of fiber properties. Such relaxation is generally carried out under conditions that produce from about 5% to 35% extrudate shrinkage.

DETERMINATION OF BUBBLE COUNT

Representative samples of the final tow produced by the fiber-forming procedure are taken at approximately 2-inch lengths of tow at various positions along the tow length. The samples are uniformly mixed to provide a random composite and uniformly carded and decrimped to provide a bundle of parallelly disposed individual filaments. From the large filament bundle thus provided are selected approximately two hundred individual filaments for bubble counts. Using a suitable magnifier, individual filaments are then examined and their bubble counts are recorded. After the bubble count of an individual filament has been determined, it is placed so as to form a pile of examined filaments. After the bubble count of examined filaments reaches about 50, examination is stopped and the pile of examined filaments is weighed. From the weight and bubble count of the examined filaments, the number of bubbles per gram of filaments is calculated and reported.

The invention is more fully illustrated in the examples which follow wherein all parts and percentages are by weight unless otherwise specified.

EXAMPLE 1

Side by side comparisons were made using a horizontally disposed extruder and a vertically disposed extruder in meltspinning a fusion melt of acrylonitrile polymer and water. The horizontally disposed extruder employed followed the description in U.S. Pat. No. 3,991,153. The vertically disposed extruder employed followed the description in the present application. The polymer employed had a composition of 88.3% acrylonitrile and 11.7% methyl methacrylate with a kinematic molecular weight of 40,000. Kinematic molecular weight ($M_k$) is obtained from the relationship:

$$\mu = 1/A(M_k)$$

wherein $\mu$ is the average effluent time in seconds for a solution of 1 gram of polymer in 100 milliliters of 53 weight percent aqueous sodium thiocyanate solvent at 40° C. multiplied by the viscometer factor and A is the solution factor derived from a polymer of known molecular weight. The polymer, 85 parts, and water, 15 parts, were prepared as a fusion melt in the extruders and extruded through a spinneret containing 2937 orifices each of 85 micron diameter. The extrudate entered directly into a steam-pressurized solidification zone maintained at 22 psig with saturated steam. Stretching of the filaments was at a stretch ratio of 1.6 in a first stage and 10 in a second stage. Bubble counts per gram of filament were observed in a representative number of filaments. Using the vertically disposed extruder of the present invention a bubble count of 36 was obtained. Using the horizontally disposed extruder of U.S. Pat. No. 3,991,153, a bubble count of 82 was observed. Although a bubble count of 100 or less per gram of filament is considered satisfactory, the lower the count the better is the quality of the fiber. The results show that the vertically disposed extruder unexpectedly provides reduced bubble count over that obtained with a horizontally disposed extruder.

We claim:

1. A process for preparing acrylonitrile polymer fiber which comprises continuously feeding a particulate composition of about 70 to about 95 weight percent of a fiber-forming acrylonitrile polymer and, correspondingly, from about 30 to about 5 weight percent of water into the top of a vertically disposed compression zone operating at a compression ratio of greater than about 1:1 and less than about 1:3 and a temperature sufficient to provide a fusion melt at autogeneous pressure, said feeding being conducted at a rate which satisfies the operating capacity of said compression zone so as to provide a vapor seal, and extruding the resulting fusion melt from the bottom of said compression zone through a spinnerette assembly using the pressure generated within said compression zone, said extruding being directly into a steam-pressurized solidification zone maintained under conditions which control release of water from the nascent filaments to prevent deformation thereof.

2. The process of claim 1 wherein said nascent filaments are stretched for molecular orientation while in said solidification zone.

3. The process of claim 2 wherein said stretching is at a stretch ratio of at least about 25.

4. The process of claim 2 wherein said stretching is conducted in two stages with the first stage being conducted at a stretch ratio less than that of the second stage.

* * * * *